US007444795B2

(12) United States Patent
Yasuhira

(10) Patent No.: US 7,444,795 B2
(45) Date of Patent: Nov. 4, 2008

(54) GAS SEAL-IN METHOD FOR A BAG WITH A GAS FILLING COMPARTMENT AND PACKAGING METHOD FOR A BAG WITH A GAS FILLING COMPARTMENT

(75) Inventor: Masanori Yasuhira, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 35 days.

(21) Appl. No.: 11/585,726

(22) Filed: Oct. 24, 2006

(65) Prior Publication Data

US 2007/0089377 A1 Apr. 26, 2007

(30) Foreign Application Priority Data

Oct. 25, 2005 (JP) ..... 2005-310544

(51) Int. Cl.
*B65B 31/00* (2006.01)
*B65B 61/00* (2006.01)
*B65B 3/00* (2006.01)

(52) U.S. Cl. ..... 53/403; 53/410; 53/469; 53/79; 53/133.2; 53/284.7

(58) Field of Classification Search ..... 53/403, 53/410, 469, 472, 79, 133.2, 284.7; 206/522; 383/3, 40
See application file for complete search history.

(56) References Cited

U.S. PATENT DOCUMENTS 3,340,669 A * 9/1967 Farquharson ..... 206/522
3,730,240 A * 5/1973 Presnick ..... 383/3
4,136,502 A * 1/1979 Shore ..... 53/79
4,216,639 A * 8/1980 Gautier ..... 426/410
4,240,556 A * 12/1980 Field ..... 206/522
4,267,684 A * 5/1981 Ambrose ..... 53/472
4,905,450 A * 3/1990 Hansen et al. ..... 53/410
5,272,856 A * 12/1993 Pharo ..... 53/472
5,447,235 A * 9/1995 Pharo ..... 206/522
5,454,642 A * 10/1995 De Luca ..... 383/3
5,588,532 A * 12/1996 Pharo ..... 206/522
5,788,121 A * 8/1998 Sasaki et al. ..... 222/105

(Continued)

FOREIGN PATENT DOCUMENTS

GB 1598843 A * 9/1981

(Continued)

*Primary Examiner*—Stephen F. Gerrity
(74) *Attorney, Agent, or Firm*—William L. Androlia; H. Henry Koda

(57) ABSTRACT

A method for sealing-in a gas in a gas filling compartment 5 of a bag having a cut-in 6 formed near the upper edge of the gas filling compartment. In the method, two edges of the bag with the contents inserted therein are gripped by grippers and suspended, the blow-in port of a gas (air) blow-in nozzle is brought to contact the cut-in, the back surface side of the bag is supported by a backing member, gas (air) is blown into the gas filling compartment, and the position below the cut-in is held from both sides of the bag by a gas cut-off grippers while the gas blow-in continues, so that the gas inside the gas filling compartment is not allowed to escape from the cut-in, and then the entire bag mouth, including the cut-in, is sealed.

23 Claims, 15 Drawing Sheets

U.S. PATENT DOCUMENTS

| | | | | |
|---|---|---|---|---|
| 6,569,283 | B1 * | 5/2003 | Sperry et al. | 156/583.2 |
| 6,745,540 | B2 * | 6/2004 | Hiramoto et al. | 53/133.2 |
| 6,810,636 | B2 * | 11/2004 | Resterhouse | 53/133.2 |
| 2007/0068118 | A1 * | 3/2007 | Forss | 53/403 |

FOREIGN PATENT DOCUMENTS

| | | | |
|---|---|---|---|
| JP | 64-084869 | | 3/1989 |
| JP | 01-240422 | A * | 9/1989 |
| JP | 02-098563 | | 4/1990 |
| JP | 8-1398 | | 9/1996 |
| JP | 09-132213 | | 5/1997 |
| JP | 1247027 | | 8/2005 |
| JP | 1247514 | | 8/2005 |
| SE | 518406 | C2 * | 10/2002 |
| WO | WO 2005030599 | A1 * | 4/2005 |

* cited by examiner

GAS SEAL-IN METHOD FOR A BAG WITH A GAS FILLING COMPARTMENT AND PACKAGING METHOD FOR A BAG WITH A GAS FILLING COMPARTMENT

BACKGROUND OF THE INVENTION

1. Field of the Invention

The present invention relates to a bag provided with a gas filling compartment for enhancing the shape retention and autonomy of the bag and protecting the contents packaged from shock or the like and more particularly to a method for sealing a gas into the gas filling compartment and further to a packaging method comprising for bag having a gas filling compartment that includes a process for sealing a gas into a gas filling compartment.

2. Description of the Related Art

A self-standing bag (standing pouch) is a bag that exhibits enhanced self-standing properties, innovations having been made in the shape of the bottom surface or the shapes of the bottom surface and the side surfaces thereof. Bottom-gusseted type self-standing bags manufactured such that another folded film (bottom member) is sandwiched in the bottom part of the front and back films (trunk member), and the two lateral side edge parts and bottom edge part are heat-sealed, are widely used. Self-standing bag products that are filled with contents and have the bag mouth sealed can be used in displays or on tables, and the use thereof as a resource-conserving packaging material replacing rigid containers is expanding.

With these bottom-gusseted type self-standing bags; however, when they are large in size or have a spout or the like attached at the bag mouth part, the bag will be too flexible, and problems will arise. The upper part thereof bends over when the bag is displayed or used on a table, the appearance thereof deteriorates, or the self-standing properties thereof are lost so that it topples over. Other problems are that it will be difficult to pour contents from the self-standing bag, because the bag readily bends over, and the bag will be difficult to hold. As to the latter problem, the same thing can be said about flat bags and the like in general.

For such reasons, in Japanese Design Registration Nos. 1247027 and 1247514, for example, an unbonded part is formed in the bag outside of the contents storing section, or, more specifically, an unbonded part is formed (so as to be a gas filling compartment or air bag) in the lateral side edge sealed portion, a gas is sealed therein, and the shape retention of the bag, and handling properties when the seal is opened, are enhanced.

Meanwhile, bags comprising an inner bag and an outer bag, having a gas sealed between the inner bag and the outer bag (gas filling compartment) to protect the packaged contents accommodated inside the inner bag from shock or the like, are described in Japanese Patent Application Laid-Open (Kokai) 64-84869, 2-98563 and 9-132213 and also in Japanese Utility Model Application Laid-Open (Kokai) No. 8-1398.

However, the methods for sealing gas into the gas filling compartment which are disclosed in the related art cited above are not suitable for automation, and it has not been possible to adopt such as a part of an automated packaging operation process wherein a commonly known automated packaging apparatus such as a rotary type packaging apparatus is used.

BRIEF SUMMARY OF THE INVENTION

Accordingly, it is an object of the present invention, which is devised in view of such problems as these, to make it possible, in packaging contents to be packaged using a bag with a gas filling compartment (or with an air bag), to automate both the seal-in process for sealing gas into gas filling compartments and the overall packaging process including such a seal-in process.

The above object is accomplished by unique steps of the present invention for a method that seals gas in a bag having a gas filling compartment; and in the present invention;

- the method uses a bag with a gas filling compartment which is capable of having a gas sealed therein and is separated from the contents storing section, the bag being further formed, in the surfaces of films that define the gas filling compartment, with a means for introducing gas (cut-in(s) or hole(s) formed in the films) for effecting communication between the inside of the gas filling compartment and the outside of the bag; and
- the method includes the steps of:
  - placing the blow-out port of a nozzle, which is connected to a pressurized gas supply source, against the means for introducing gas and supporting the back surface side of the bag with a backing member;
  - blowing the gas from the nozzle into the inside of the gas filling compartment through the means for introducing gas;
  - gripping a part near the means for introducing gas from both surfaces of the bag with a blocking gripper while the gas blow-in continues, thus cutting off a flow of gas between the means for introducing gas and an inside of the gas filling compartment; and
  - sealing the means for introducing gas, thus allowing the gas to be sealed in the gas filling compartment.

In the above method of the present invention, it is preferable that sealing of the means for introducing gas be effected by sealing the both surfaces of the bag at the location of the means for introducing gas. In cases that the means for introducing gas is formed in the vicinity of the bag mouth of the bag, when the bag mouth is sealed to be closed from both surfaces of the bag, the means for introducing gas can be sealed together therewith and the gas is sealed inside the gas filling compartment, and preferably that should be done in that way.

In addition, in the present invention, the gas filling compartment is formed between the films that make the front and back surfaces in the sealed portions at the lateral side edges of the bag (that form an unbonded part having a closed contour inside the sealed portions); alternatively, when the films that make the front and back surfaces of the bag are laminated films, the gas filling compartment is formed in the interior of at least one pair of laminated films (that form an unbonded part having a closed contour between the laminated films). In such cases, it is preferable that the gas filling compartment be formed so as to be oriented downward from the vicinity of the upper edge of the lateral side edge sealed portion and that the means for introducing gas be formed in the vicinity of the upper edge of the gas filling compartment, so that positions downward from the means for introducing gas are held by the cut-off gripper, cutting off the flow of gas between the means for introducing gas and the inside of the gas filling compartment, and so that when the bag mouth is sealed from both surfaces of the bag, the means for introducing gas is sealed together therewith, thus sealing the gas inside the gas filling compartment of the bag.

In the present invention, the above-described gas seal-in method can be used to a spout-equipped bag in which a spout is inserted and sealed in the bag mouth of a bag that has a gas filling compartment. When the present invention is used to such a spout-equipped bag, it is preferable that the gas filling compartment extend downward from the vicinity of the upper edges of the lateral side edge sealed portions, and the means for introducing gas be formed in the vicinity of the upper edge of the gas filling compartment; and it is also preferable that after holding the positions downward from the means for introducing gas with a cut-off gripper and thus cutting off the flow of gas between the means for introducing gas and the inside of the gas filling compartment, sealing be done for the bag mouth from both surfaces of the bag, so that sealing be performed both between the films at the bag mouth and between the films at the bag mouth and the spout, and at which time the means for introducing gas be sealed together therewith, thus sealing the gas inside the gas filling compartment.

The above-described object is further accomplished by unique steps of the present invention for a packaging method in which bags, held at both lateral side edges thereof by grippers and suspended, are conveyed continuously or intermittently; and, during the course of the bag conveyance, various packaging processes including bag mouth opening, filling the bag with contents to be packaged, and bag mouth sealing are successively performed; and in the present invention, the method uses a bag with a gas filling compartment which is capable of having a gas sealed therein and is separated from the contents storing section, the bag being further formed, in the surfaces of films that define the gas filling compartment, with a means for introducing gas (cut-in(s) or hole(s) formed in the films) for effecting communication between the inside of the gas filling compartment and the outside of the bag, and the means for introducing gas being formed in the vicinity of the bag mouth of the bag; and wherein, a process for sealing gas in the gas filling compartment of the bag is executed after a process for filling the bag with contents to be packaged; and the process for sealing gas comprises the steps of:

placing a blow-out port of a nozzle, which is connected to a pressurized gas supply source, against the means for introducing gas and supporting a back surface side of the bag with a backing member, blowing a gas from the nozzle into an inside of the gas filling compartment through the means for introducing gas, gripping a part near the means for introducing gas from both surfaces of the bag by a blocking gripper while the gas blow-in continues, thus cutting off a flow of gas between the means for introducing gas and an inside of the gas filling compartment, and sealing the bag mouth of the bag from both surfaces of the bag, at which time the means for introducing gas is sealed together therewith, thus sealing the gas inside the gas filling compartment.

In the above-described packaging method of the present invention, for the structure and gas seal-in method for a specific bag with a gas filling compartment, the structure and seal-in method already described can be used.

In addition, the above-described packaging method of the present invention can be used for a spout-equipped bag. When the packaging method of the present invention is used for a spout-equipped bag as well, for the structure and gas seal-in method for a specific bag with a gas filling compartment, the structure and seal-in method already described can be used.

As seen from the above, by using the gas seal-in method of the present invention, both the seal-in process for sealing gas into gas filling compartments and the overall packaging process comprising that seal-in process can be automated; and, when packaging contents to be packaged using a bag with a gas filling compartment, in the present invention it is possible to perform packaging operations efficiently, using a commonly known automatic packaging apparatus such as a rotary type packaging apparatus, for example.

DETAILED DESCRIPTION OF THE INVENTION

The present invention is now described below specifically with reference to FIG. 1 to 16.

Figure 1:
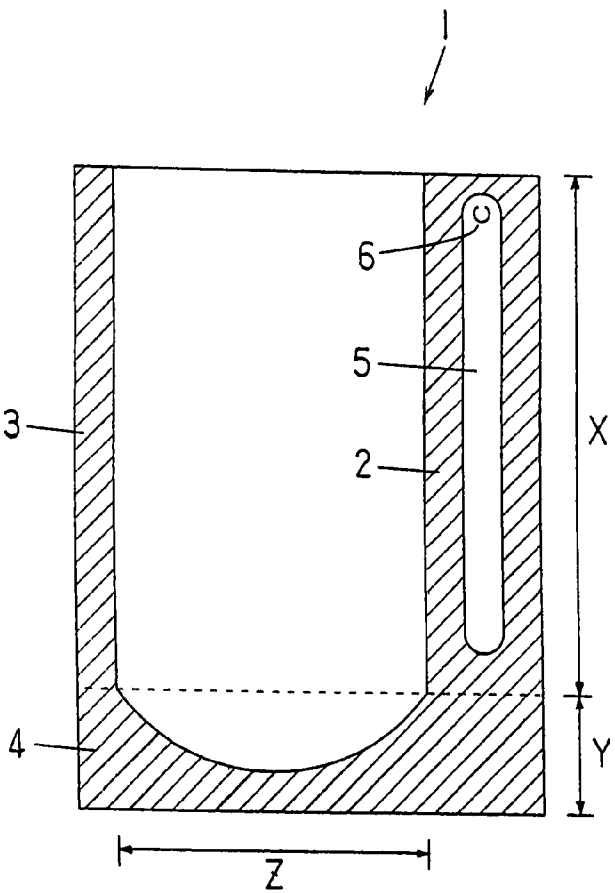
FIG. 1 is a schematic front elevational view of a bag with a gas filling compartment that can be used in the present invention.
Figure 2A:
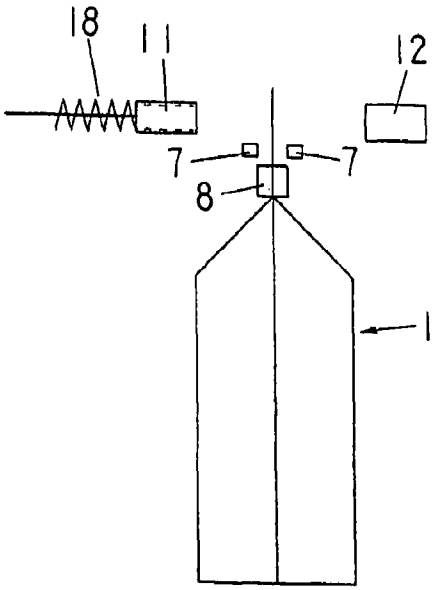
FIGS. 2(*a*) through 2(*d*) are side elevational views showing the process order in a gas seal-in method and packaging method using the bag of FIG. 1.
Figure 2B:
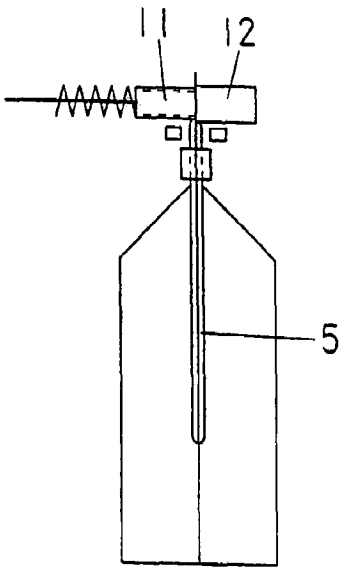
Figure 2C:
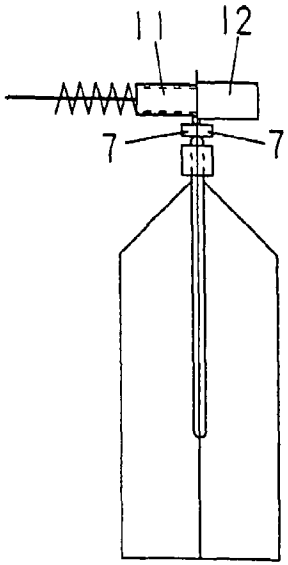
Figure 2D:
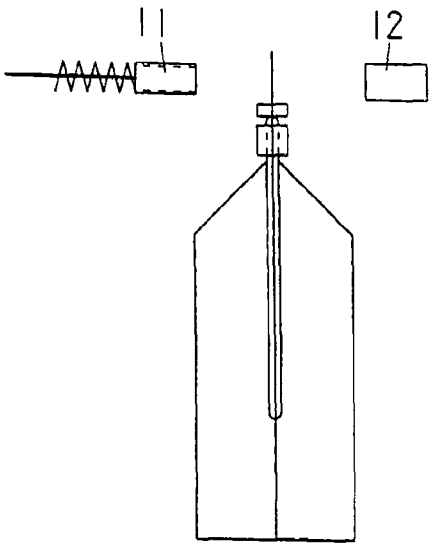

A bag with a gas filling compartment I of the present invention is shown in FIG. 1. The bag 1 is a bottom-gusseted type self-standing bag comprising front and back side films and folded bottom part films. In the lateral side edge area X of the bag 1, the front and back side films of the bag are bonded together; at the lateral side edge area Y, the front and back side films are bonded sandwiching the bottom part films (with the bottom part films themselves bonded together on the inside where folded); at the bottom part area Z the front and back side films are bonded respectively to the bottom part films (with the bottom part films not bonded to each other); at the upper edge, the front and back side films are not bonded, resulting in an open bag mouth. The sealed portions 2 and 3 in the two lateral side edge areas X and the sealed portion 4 in the side part area Y and bottom part area Z are indicated by crosshatching. In part of the sealed portion 2, an unbonded part (gas filling compartment or air bag) 5 is formed where the front and back side films are not bonded together.

The gas filling compartment (air bag) 5 is a place left unsealed, without having pressure applied thereto when the front and back side films are heat-sealed, having a closed outline extending narrowly downward from the vicinity of the upper edge of the sealed portion 2, with a circular arc-shaped cut-in (a means for introducing a gas) 6 formed in the film surface (on the front side in FIG. 1) in the vicinity of the upper edge thereof for causing the inside of the gas filling compartment 5 to communicate with the outside of the bag.

Next, the method for manufacturing a bag with a gas filling compartment (packaging method) with a rotary type packaging apparatus, using the bag with a gas filling compartment 1, will be described with reference to FIGS. 2(*a*) to 5.

In a rotary type packaging apparatus, in general, a plurality of pairs of grippers is provided at equal intervals about the periphery of an intermittently turning table, bags are supplied to the grippers, the bags are held suspended, gripped by the grippers at the two lateral side edges thereof, and conveyed intermittently, and such packaging operations as bag mouth opening, packaging contents filling, and bag mouth sealing are performed successively at each of a number of stop positions. Additionally, when bag with a gas filling compartment (or with an air bag) is used, and a gas is sealed inside the gas filling compartments thereof, a gas filling process and a process for closing (sealing) the above-described cut-in will also be necessary.

For that reason, when applying the seal-in method and packaging method of the present invention to the above-described bag with 1 a gas filling compartment, in addition to deploying gas filling means at the stop position where the above-described gas filling process is effected, auxiliary grippers (cut-off grippers) are provided for gripping the bag 1 at prescribed locations from both sides, one pair each in correspondence with each pair of grippers. This is the main point of difference between the rotary type packaging apparatus used in the present invention (see FIG. 5) and an ordinary rotary type packaging apparatus.

Figure 4C:
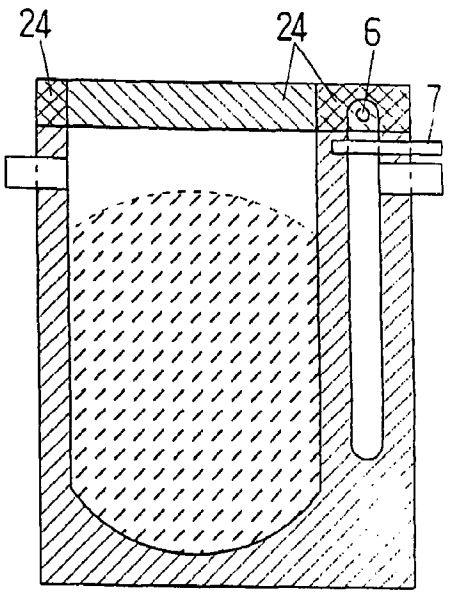
FIGS. 4(*a*) through 4(*c*) are schematic front elevational views of the bag with a gas filling compartment when, in the gas seal-in method and packaging method of the present invention, the bag is at, respectively, the contents filling process position, the gas filling process position, and the bag mouth sealing process position.
Figure 4B:
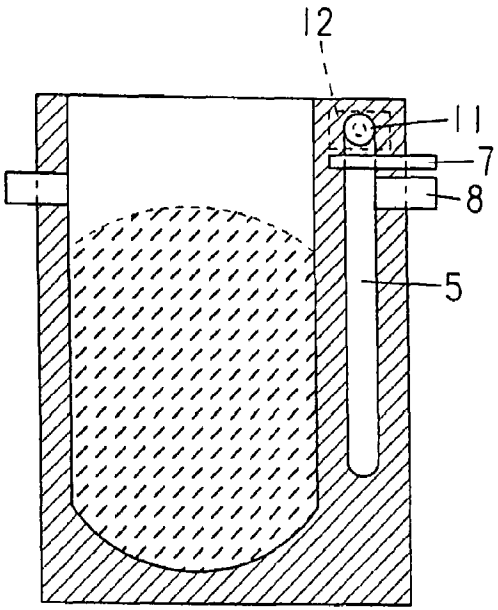
Figure 4A:
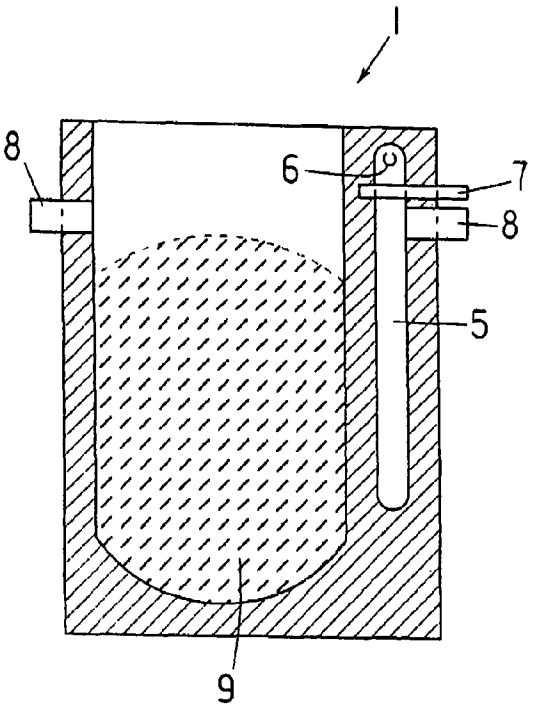

The auxiliary grippers 7, which are provided horizontally, in the length direction, at positions directly above the grippers 8 on one side, are capable of opening and closing so as to be able to hold the bag 1 from both sides. FIG. 4(*a*) is a front elevational view of the bag 1 (after filling) in the filling process position where the inside of the bag 1 is filled with the contents 9 to be packaged in the contents storing section. At this point in time, the auxiliary grippers 7 are not closed; however, as may be understood from the same figure, when the auxiliary grippers 7 are closed, the bag surfaces below the cut-in 6 will be held from both sides so as to cross the gas filling compartment 5 of the sealed portion 2, cutting off the flow of gas between the cut-in 6 and the inside of the gas filling compartment 5.

The gas filling means comprise a gas (air) blow-in nozzle 11 and a backing member 12, described further below.

The packaging method is performed in the following manner using the rotary type packaging apparatus shown in FIG. 5.

(1) At stop position I (bag supply process position), a bag 1 is supplied to grippers 8 and 8 from a conveyor magazine-type bag supplying mechanism 13.

(2) At stop position II (print process position), the surface of the bag is printed by a printer (only the head unit 14 is shown).

(3) At stop position III (mouth opening process position), the bag mouth is opened by a mouth opening mechanism (indicated only by a suction plate 15 and a mouth opening head 16).

(4) At stop position IV (filling process position), the filling of a liquid (contents 9 to be packaged) is performed by a filling mechanism (indicated only by a nozzle unit 17).

(5) At stop position V (gas filling process position), as shown in FIG. 2(*a*), the blow-in nozzle 11, connected to a pressurized air (gas) supply source through a switchover valve or the like (not shown), is provided, just in front of the cut-in 6 formed in the bag 1, and the backing member 12 is provided, opposing the blow-in nozzle 11 on the opposite side, so as to sandwich the bag 1. The blow-in nozzle 11 is energized forward by a compression spring 18.

Figure 6:
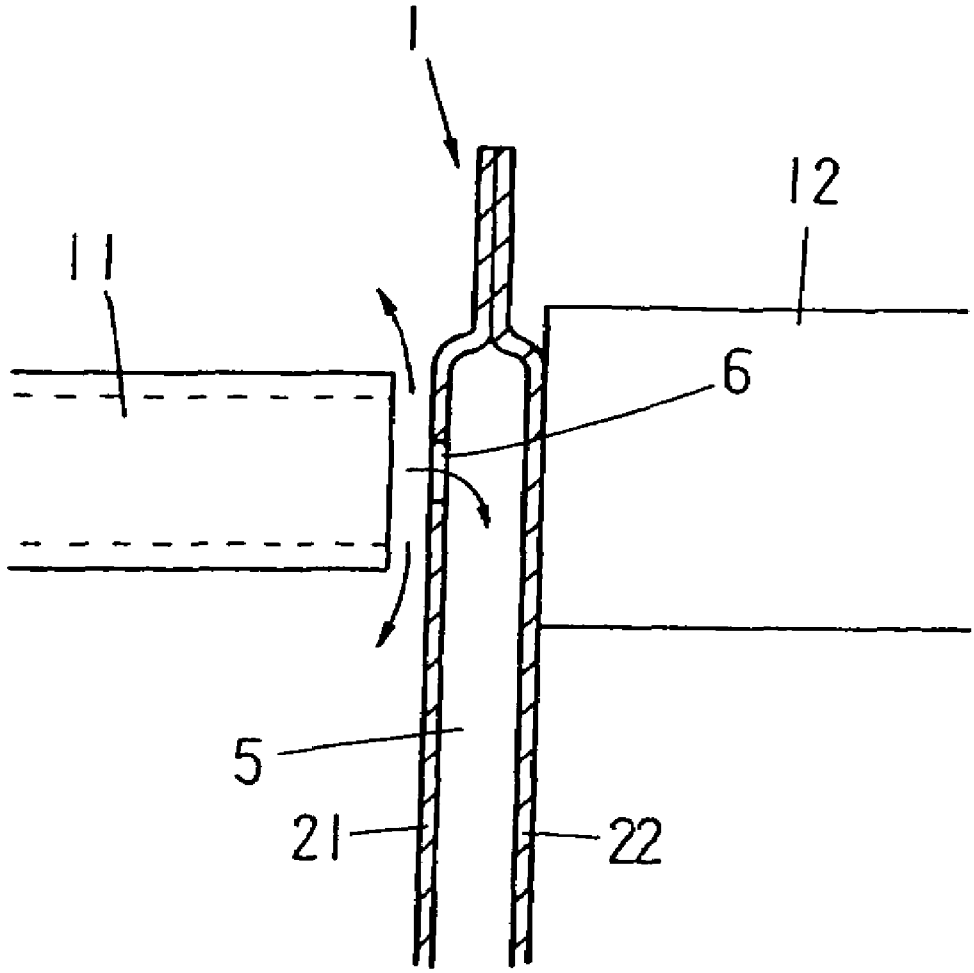
FIG. 6 is a side view showing the gas filling done by a gas blow-in nozzle in the methods of the present invention.
Figure 8A:
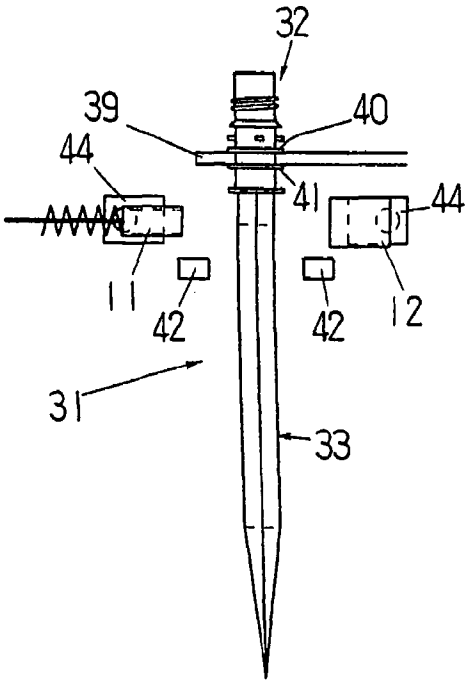
FIGS. 8(*a*) through 8(*d*) are side elevational views showing the process order in the gas seal-in method and packaging method that uses a spout-equipped bag.
Figure 8B:
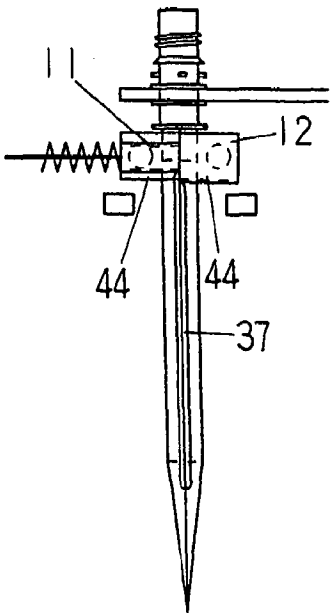
Figure 8C:
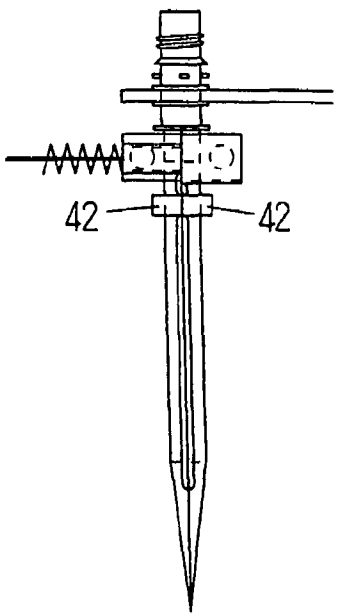
Figure 8D:
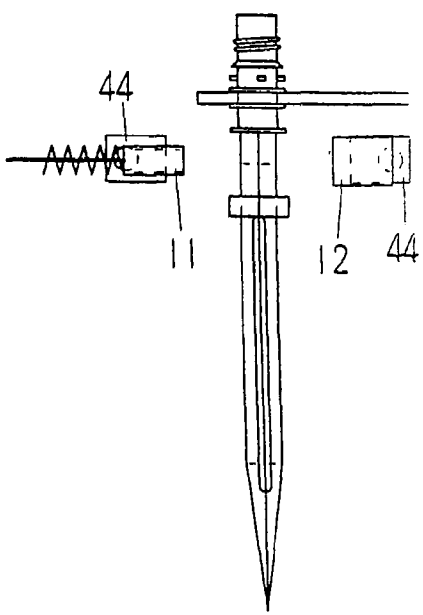

As seen from FIG. 2(*a*), when the bag 1 stops at this gas filling process position, the blow-in nozzle 11 and the backing member 12 are in standby positions. Then, as shown in FIG. 2(*b*), the blow-in nozzle 11 and the backing member 12 advance together, a blow-in port at the tip of the blow-in nozzle 11 makes contact with the bag surface at the periphery of the cut-in 6, the back side thereof is supported by the backing member 12, and pressurized air is simultaneously blown out from the tip of the blow-in nozzle 11. When this air (gas) blow-out starts, due to that air (gas) pressure, the blow-in nozzle 11 moves back slightly against the energizing force of the compression spring 18, whereby, as shown in FIG. 6, a gap develops between the films 21 and 22 configuring the gas filling compartment 5, air (gas) is blown through the hole in the cut-in 6 into the inside of the gas filling compartment 5, and the gas filling compartment 5 distends. The gas blown in may be a gas other than air.

Then, as shown in FIG. 2(*c*) and FIG. 4(*b*), the auxiliary grippers 7 close and hold the bag surfaces directly below the cut-in 6 from both sides, the flow of gas between the cut-in 6 and the inside of the gas filling compartment 5 is cut off, and the air (gas) inside the gas filling compartment 5 is prevented from escaping through the cut-in 6 to the outside. Next, the blowing out of air (gas) from the blow-in nozzle 11 (in other words, the blowing in of air to the inside of the gas filling compartment 5) is stopped.

Last of all, as shown in FIG. 2(*d*), the blow-in nozzle 11 and the backing member 12 move back away from the bag surfaces, so that the gas filling process ends.

Figure 3G:
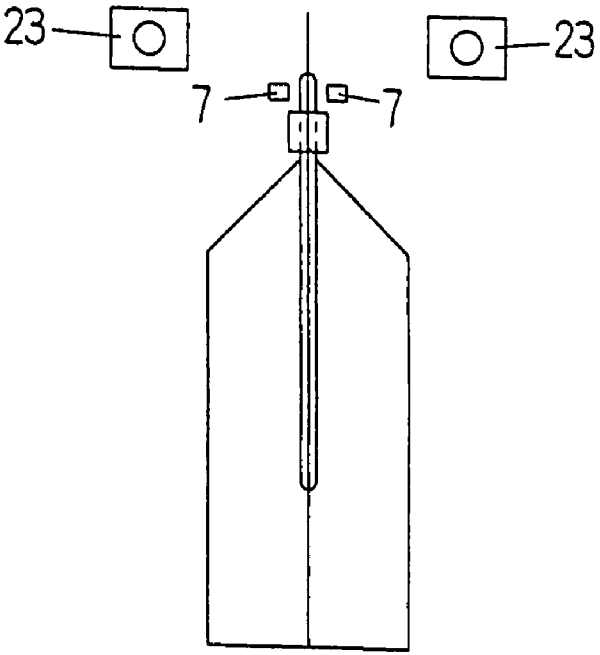
FIGS. 3(*e*) through 3(*g*) show the process order after the step of FIG. 2(*d*)
Figure 3F:
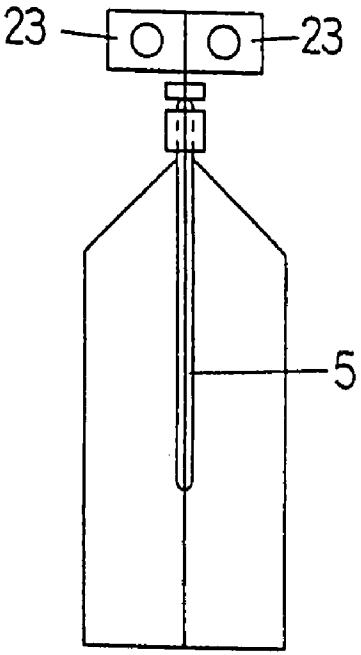
Figure 3E:
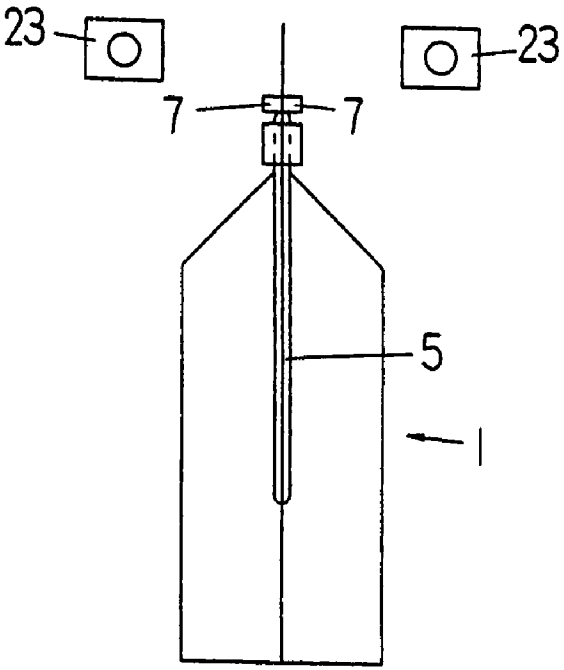

(6) At stop position VI (first sealing process position), a first sealing mechanism (indicated only by a pair of hot plates 23) for sealing the bag mouth is provided. When the bag 1 stops at the first sealing process position, as shown in FIG. 3(*e*), the hot plates 23 are in standby positions at a certain distance from the bag 1. The hot plates 23 have a width in the height direction capable of covering the cut-in 6. When they close and pressure-hold the bag from both sides, as shown in FIG. 3(*f*), the films 21 and 22 of the bag mouth are sealed, sealing the contents to be packaged inside the bag 1, and, simultaneously therewith, the films 21 and 22 are sealed and closed also at the location of the cut-in 6, sealing the air (gas) inside the gas filling compartment 5. The sealed portions 24 of the bag mouth, sealed by the hot plates 23, are shown in FIG. 4(*c*). In this way, the first sealing process effects both the bag mouth seal and the cut-in 6 seal.

Then, as shown in FIG. 3(*g*), the hot plates 23 and the auxiliary grippers 7 open, so that the first sealing process ends.

(7) At stop position VII (second sealing process position), a second sealing mechanism (indicated only by a pair of hot plates 25) for sealing the bag mouth is provided, and a second sealing process is performed which pressure-holds the sealed portion 24 again with the hot plates 25, combining the sealing of the bag mouth and the sealing of the cut-in 6, as in the first sealing process.

(8) At stop position VIII (seal cooling and discharge process position), a seal cooling mechanism (indicated only by a pair of cooling plates 26) is provided for cooling the bag mouth sealed portions 24. The bag surfaces are pressure-held by the cooling plates 26 and cooled, the grippers 8 and 8 open during that cooling, then the cooling plates 26 open, and the bag 1 (the bag with a gas filling compartment product) is discharged by a chute 27 to the outside of the apparatus.

The cut-in 6 formed in the film surface of the bag 1 is, moreover, a cut line which itself has no planar size. Ordinarily, this is in a substantially closed condition, but opens due to air (gas) pressure when air (gas) is being blown in. The bag surfaces are held by the auxiliary grippers 7 and the flow of gas between the cut-in 6 and the inside of the gas filling compartment 5 is cut off, after which, when the blow-in nozzle 11 has moved back, the cut-in 6 returns to the closed condition. Then, when the bag mouth has been heat-sealed, the film 21 and the film 22 are sealed together; however, at that time, at the location of the cut-in 6, because the film 21 is sealed with the film 22 while the cut-in 6 is in the closed condition, the result is that, in terms of outward appearance, the condition is tantamount to one wherein there is substantially no cut-in 6.

A hole can be formed in place of the cut-in 6 as a means for introducing a gas; however, as described in Japanese Patent Application Laid-Open (Kokai) No. 1-227803, when a hole is made and used, the sealant material (film) adheres to the sealing hot plates, and overruns from the hole to the periphery; accordingly, a cut-in that can prevent such a problem is preferable.

Figure 7:
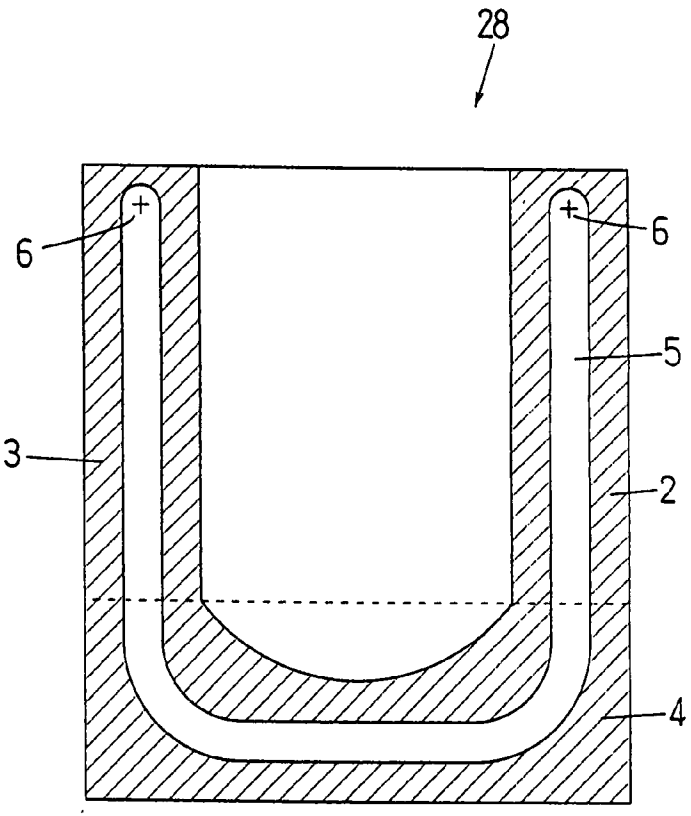
FIG. 7 is a schematic front elevational view of another type of bag with a gas filling compartment that can be used in the present invention.

A bag with a gas filling compartment 28 (bottom-gusseted type self-standing bag) in another embodiment of the present invention is shown in FIG. 7. In FIG. 7, the same symbols are used for the elements that are substantially the same as in the bag 1 shown in FIG. 1.

The unbonded part 5 (gas filling compartment) formed in the bag 28 is formed in the sealed portions 2 and 3 at the two lateral side edges and in the sealed portion 4 extended further downward, forming overall a U-shaped closed contour. This gas filling compartment 5 is formed between the films 21 and 22 of the front and back surfaces in the sealed portions 2 and 3, and, in the sealed portion 4, is formed between the one film 21 of the front and back surface films (the front side film in FIG. 7) and the film forming the bottom part, and between the other film 22 (the back side film in FIG. 7) and the film forming the bottom part (that is, one each, front and back), which two parts are connected.

In the film surface in the vicinity of the upper edge of the gas filling compartment 5, a cross-shaped cut-in 6 is formed which causes the inside of the gas filling compartment 5 and the outside of the bag to communicate. In this embodiment, moreover, a cut-in 6 is formed at both tip ends of the U shape, but may be formed at only one tip end.

For this bag with a gas filling compartment 28 also, the same gas seal-in method and packaging method as are performed on the bag 1 can be applied. However, if two cut-ins 6 are formed, an auxiliary gripper, blow-in nozzle, and backing member are required for each cut-in.

In both the bag 1 and the bag 28, moreover, the gas filling compartment is formed between the front and back surface films themselves and between the front and back surface films and the bottom part film; however, in cases where the front and back surface films are laminated films, a gas filling compartment having a closed contour extending in the longitudinal direction can be formed in the interior of at least one of the pairs of laminated films. That gas filling compartment can be formed, when films are laminated to form front and back surface laminated films, by leaving them unbonded in a prescribed contour.

Next, the method (packaging method) for manufacturing a spout-equipped bag product with, for example, a rotary type packaging apparatus by way of using a bag that is provided with a gas filling compartment and with a spout which is inserted into and sealed in the bag mouth of the bag (such bag being called "spout-equipped bag") will be described with reference to FIGS. 8(*a*) to FIG. 11(*c*).

Figure 11A:
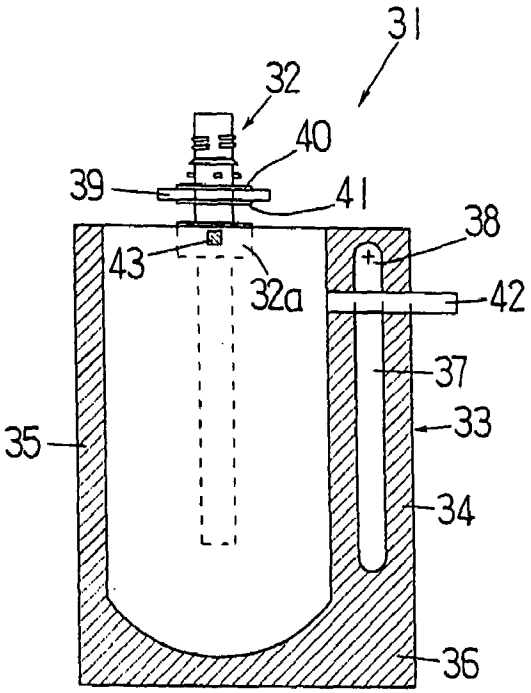
FIGS. 11(*a*) through 11(*c*) are schematic front elevational views of the spout-equipped bag when, in the gas seal-in method and packaging method of the present invention, the bag is at, respectively, the temporary sealing process position, the primary main sealing process position, and the secondary main sealing process position.
Figure 11B:
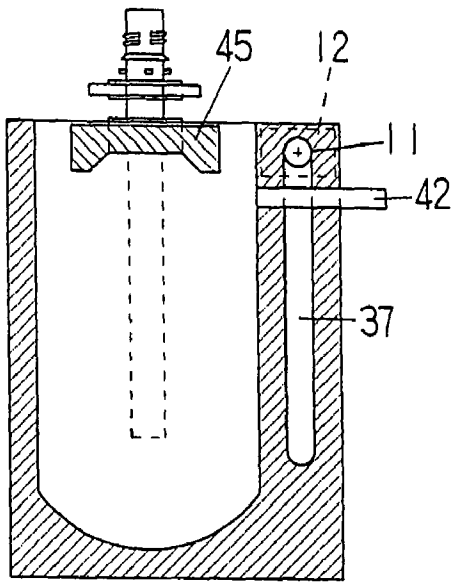
Figure 11C:
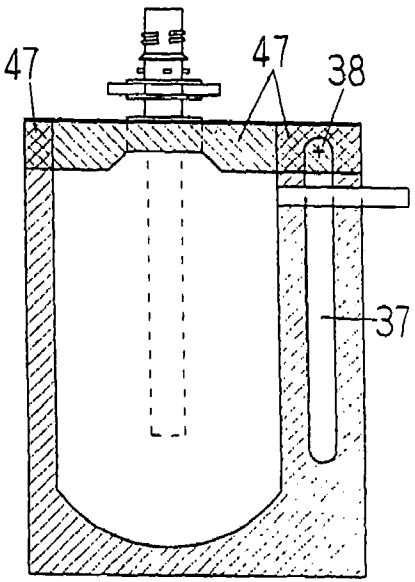

The spout-equipped bag 31, shown in FIG. 11(*a*), is comprised of a spout 32 and a bag that has a gas filling compartment 33 sealed together. The bag with a gas filling compartment 33, until the spout 32 is sealed therewith, is a bottom-gusseted type bag like the bag 1 represented earlier, with sealed portions 34 to 36 formed in the two lateral side edge areas and in the bottom part area, and an unbonded part (gas filling compartment) 37 formed in the sealed portion 34. The gas filling compartment 37 has a closed contour extending narrowly downward from the vicinity of the upper edge of the sealed portion 34, with a cross-shaped cut-in 38 for causing the inside of the gas filling compartment 37 and the outside of the bag to communicate formed in the film surface in the vicinity of the upper edge thereof.

The rotary type packaging apparatus used here, as shown in FIGS. 8(*a*) to 8(*d*) and FIGS. 11(*a*) to 11(*c*), has a plurality of spout holding members 39 deployed at equal intervals about the periphery of a turning table that turns intermittently. The spout holding members 39 are bifurcated members, which are inserted between upper and lower flanges 40 and 41 formed in the spout 32 to hold the spout 32. In this rotary type packaging apparatus, the spouts 32 held by the spout holding members 39 are conveyed intermittently, and, at each stop position, packaging processes, such as the bag 33 supply and temporary sealing with the spout, the main sealing (primary and secondary) between the bag 33 and the spout 32, the filling with the contents to be packaged (liquid substance), and capping the spout, are successively performed. As in the rotary type packaging apparatus shown in FIG. 5, moreover, as parts of the packaging process, a process for filling the gas filling compartment with a gas and a process for closing (sealing) the cut-in or cut-ins of the gas filling compartment are required, gas filling means are provided for the above-described gas filling process, and, besides that, auxiliary grippers (cut-off grippers) 42 for gripping prescribed places on the bag 33 from both sides are provided in the turning table, in correspondence with the spout holding members 39.

The auxiliary grippers 42 are provided at positions diagonally downward from the spout holding members 39 (positions directly below the sealing hot plates described subsequently), with the length direction thereof made horizontal, and are capable of opening and closing so that they can hold the bag 33 from both sides. FIG. 11(*a*) is a front elevational view of the bag at the temporary sealing process position for temporarily sealing the spout 32 and the bag 33. At this point in time, the auxiliary grippers 42 are not closed; however, as can be understood from the same figure, when the auxiliary grippers 42 are closed, the bag surfaces below the cut-in 38 are held from both sides so as to cross the gas filling compartment 37 formed in the lateral side edge sealed portion 34, so that the flow of gas between the cut-in 38 and the gas filling compartment 37 is cut off.

The gas filling means, moreover, comprise the same blow-in nozzle 11 and backing member 12 as shown in, for instance, FIGS. 2(*a*) through 2(*d*).

The packaging method using this rotary type packaging apparatus is effected as follows:

(1) First, the spout 32 is supplied to a spout holding member 39, and held vertical.

(2) At the temporary sealing process position, a bag feeding mechanism for supplying the bags 33 and a temporary sealing mechanism for temporarily sealing the spout 32 and the bag 33 are provided. By the bag feeding mechanism, a bag with a gas filling compartment 33 is supplied from below to the spout 32, a bonding part 32*a* of the spout 32 enters inside the bag mouth of the bag 33, and, as shown in FIG. 11(*a*), the spout 32 and the bag 33 are temporarily sealed by the above-described temporary sealing mechanism (forming a temporary sealed portion 43).

(3) After temporary sealing, the spout-equipped bag 31 is turned and conveyed, and stops at the primary main sealing process position. At this position, as shown in FIG. 8(*a*), besides the primary main sealing mechanism (indicated only by a pair of hot plates 44), the blow-in nozzle 11 and the backing member 12 are provided, and the primary main sealing process and the gas filling process are conducted simultaneously.

In the primary main sealing process, as shown in FIG. 8(*b*), the hot plates 44 advance, pressure-hold prescribed places at the bag mouth of the bag 33, and the bonding part 32*a* of the spout 32 and the bag mouth of the bag 33, and also the films themselves at the bag mouth of the bag 33 (portions adjacent to the bonding part 32*a* of the spout 32) are primary-main-sealed. The sealing place at that time (primary main sealing part 45) is indicated in FIG. 11(*b*). Meanwhile, the gas filling process is conducted in exactly the same way as is described earlier with reference to, for instance, FIGS. 2(*a*) through 2(*d*). That is, as shown in FIG. 8(*b*), the blow-in nozzle 11 and the backing member 12 advance together, the blow-in port at the tip of the blow-in nozzle 11 makes contact with the bag surface at the periphery of the cut-in 38, the back surface thereof is supported by the backing member 12, and pressurized air (gas) is simultaneously blown out from the tip of the blow-in nozzle 11. When the gas filling compartment 37 has distended, as shown in FIG. 8(*c*) and FIG. 11(*b*), the auxiliary grippers 42 close and hold the bag surfaces directly below the cut-in 38 from both sides, cutting off the flow of gas between the cut-in 38 and the inside of the gas filling compartment 37. Then the blowing out of air (gas) from the blow-in nozzle 11 (blowing in of air (gas) to the inside of the gas filling compartment 37) is stopped. Then, as shown in FIG. 8(*d*), the blow-in nozzle 11 and the backing member 12 move back away from the bag surfaces (with the hot plates 44 moving back simultaneously).

Figure 9G:
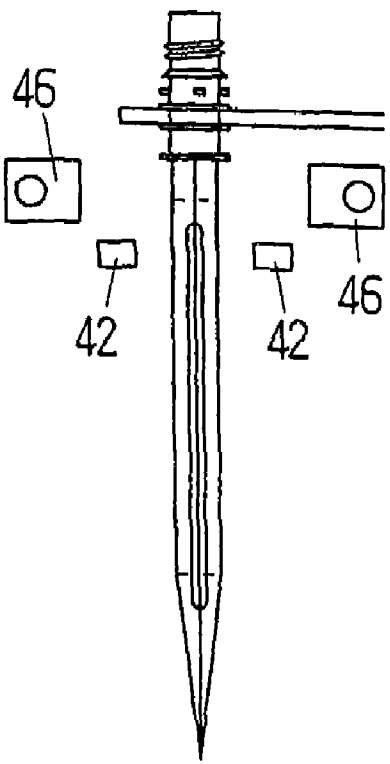
FIGS. 9(*e*) through 9(*g*) show the process order after the step of FIG. 8(*d*)
Figure 9F:
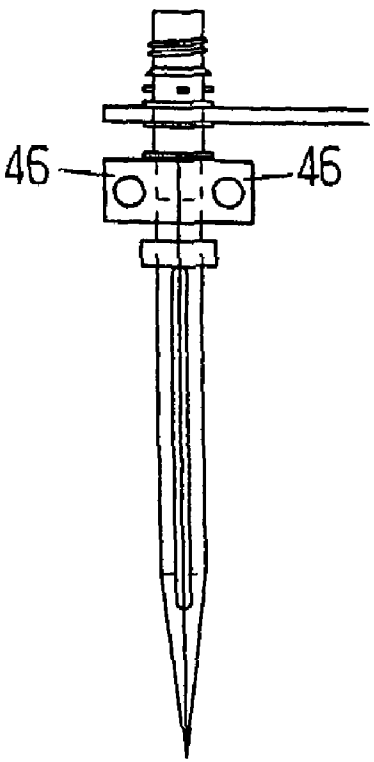
Figure 9E:
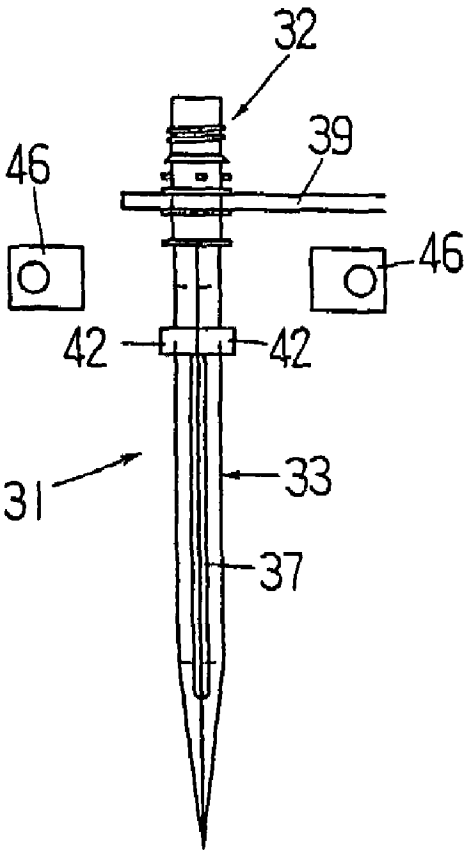

(4) Next, the spout-equipped bag 31 is turned and conveyed, and stops at the secondary main sealing process position. At this position, as shown in FIG. 9(*e*), the secondary main sealing mechanism (indicated only by a pair of hot plates 46) is provided. In the secondary main sealing process, as shown in FIG. 9(*f*), the hot plates 46 advance and hold the bag mouth of the bag 33, the bonding part 32*a* of the spout 32 and the bag mouth of the bag 33 are sealed, and, simultaneously therewith, the films at the bag mouth of the bag 33 are sealed together across their entire width (forming the secondary main sealed portions 47). At that time, the cut-in 38 is sealed together and closed, and air (gas) is sealed inside the gas filling compartment 37. The secondary main sealed portions 47 at the bag mouth sealed by the hot plates 46 are indicated in FIG. 11(*c*). In this way, the secondary main sealing process seals the spout 32 and the bag 33, seals the films of the bag 33 together, and, in addition to that, seals the cut-in 38.

Then, as shown in FIG. 9(*g*), the hot plates 46 and the auxiliary grippers 42 open, so that the secondary main sealing process ends.

Figure 10I:
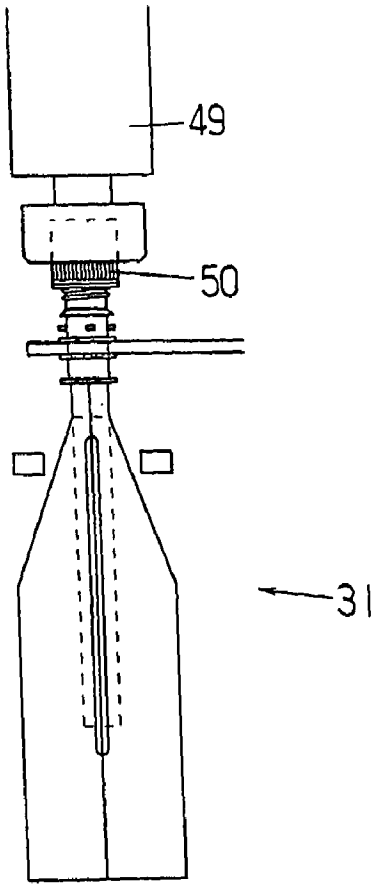
FIGS. 10(*h*) and 10(*i*) show the process order after the step of FIG. 9(*g*)
Figure 10H:
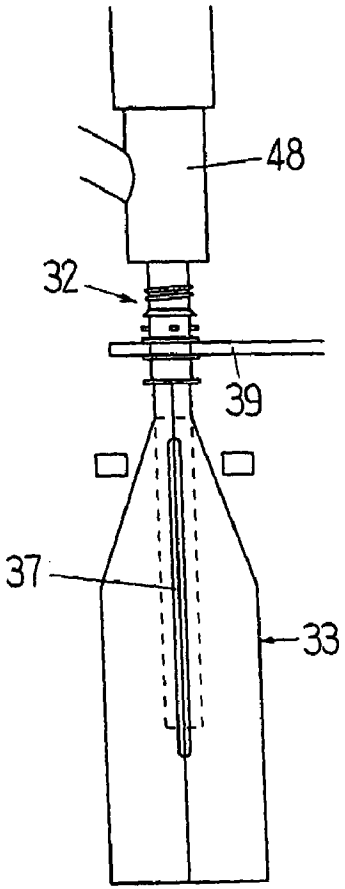

(5) At the packaged contents filling process position, as shown in FIG. 10(*h*), from a liquid filling nozzle 48, the bag receives the filling of the liquid through the spout 32. Then, at the capping process position, as shown in FIG. 10(*i*), a cap 50 is fitted to the spout mouth by a capper 49. After the capping process has finished, the spout-equipped bag 31 is turned and conveyed, and, at the discharge position (not shown) which is next, is removed from the spout holding member 39 and discharged.

Figure 12B:
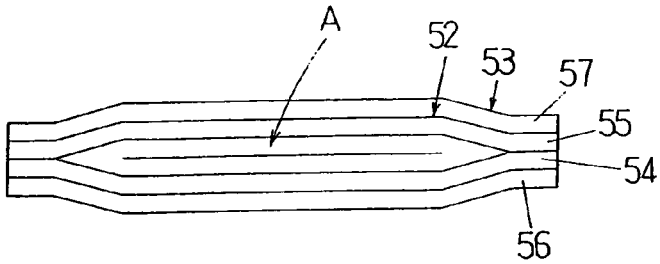
FIG. 12(*a*) is a schematic front elevational view of a bag with a gas filling compartment used in the present invention, FIG. 12(*b*) being a top view thereof, and FIG. 12(*c*) being a sectional view thereof.
Figure 12A:
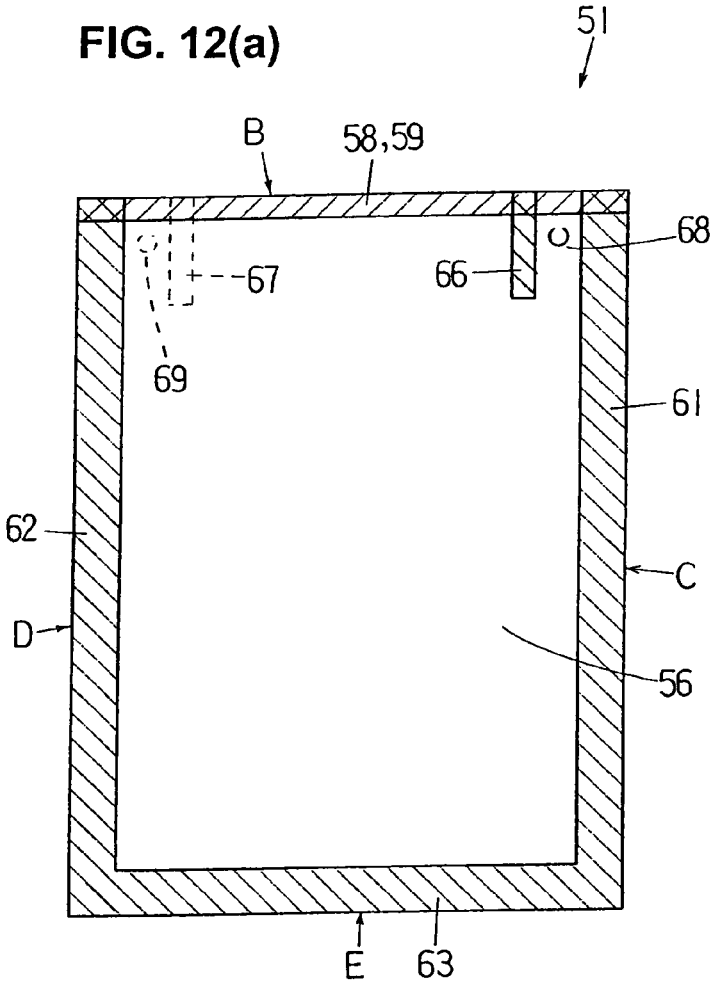
Figure 12C:
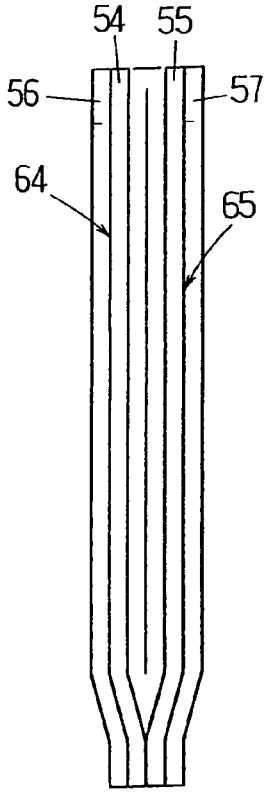
Figure 13A:
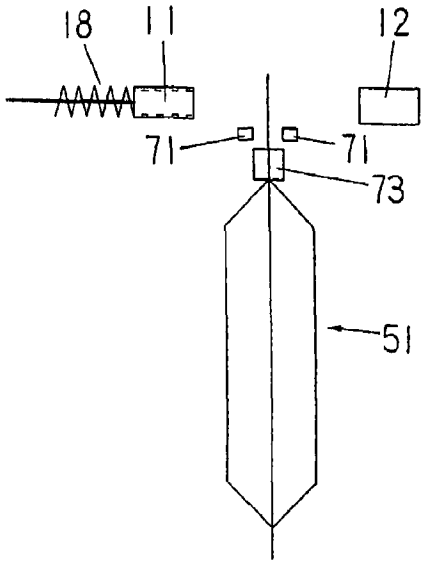
FIGS. 13(*a*) through 13(*d*) are side elevational views showing the process order in the gas seal-in method and packaging method of the present invention using the bag shown in FIGS. 12(*a*) through 12(*c*)
Figure 13B:
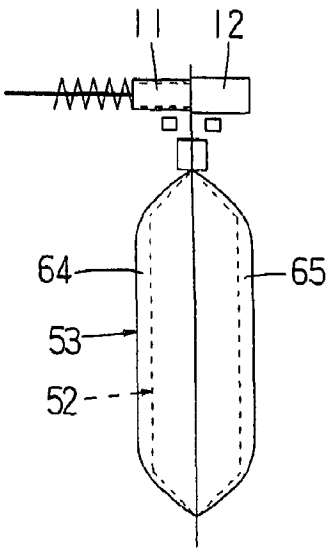
Figure 13C:
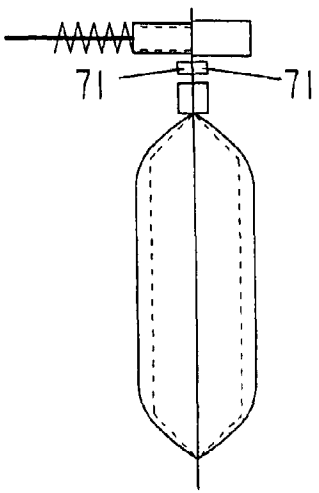
Figure 13D:
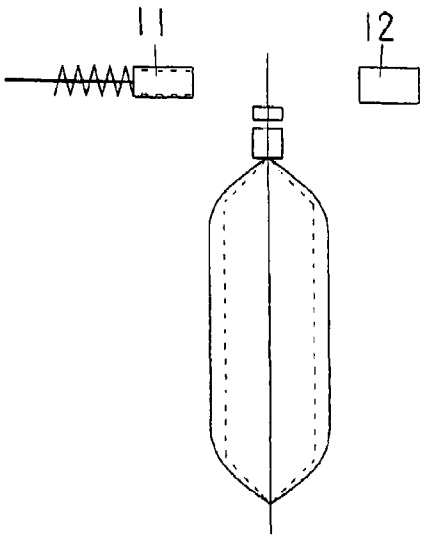

FIGS. 12(*a*) through 12(*c*) show a bag with a gas filling compartment 51 in yet another embodiment of the present invention.

The bag 51 comprises an inner bag 52 and an outer bag 53 having substantially the same width. The bag mouth A of the inner bag 52 opens, and, at the upper edge B of the bag 51, the films 54 and 55 of the inner bag 52 and the films 56 and 57 of the outer bag 53 (i.e. the adjacent films 54 and 56, and the adjacent films 55 and 57) are sealed together, one side at a time. The sealed portions 58 and 59 are indicated by crosshatching in FIG. 12(*a*). The portion where the films 54 and 56 are sealed is the sealed portion 58, and the portion where the films 55 and 57 are sealed is the sealed portion 59. Also, at the two lateral side edges C and D and lower edge E of the bag 51, the films 54 and 55 of the inner bag 52 and the films 56 and 57 of the outer bag 53 are sealed together. The sealed portions 61 to 63 are similarly indicated by crosshatching in FIG. 12(*a*).

By these sealed portions 58, 59, and 61 to 63, gas filling compartments 64 and 65 are configured, between the film 54 of the inner bag 52 and the film 56 of the outer bag 53, and between the film 55 of the inner bag 52 and the film 57 of the outer bag 53. In FIG. 12(*c*), the gas filling compartments 64 and 65 are not distended; accordingly, FIG. 12(*c*) is drawn as if there is no visible gap between the films 54 and 56 or between the films 55 and 57.

In the vicinity of the upper edge side corner of the bag 51, a supplementary sealed portion 66 wherein the film 54 of the inner bag 52 and the film 56 of the outer bag 53 are sealed together is formed, in like manner as the sealed portion 58, with a prescribed length in the longitudinal direction, connecting to the sealed portion 58, and, in the vicinity of the upper edge side corner on the opposite side, a supplementary sealed portion 67 wherein the film 55 of the inner bag 52 and the film 57 of the outer bag 53 are sealed together is formed, in like manner as the sealed portion 59, in the longitudinal direction, connecting to the sealed portion 59. The reason why the expressions supplementary sealed portions 66 and 67 are used here is that, as will be described subsequently, these sealed portions are sealed portions which are necessary, in a supplementary way, for the sealing in of the gas.

In the vicinities which are more toward the corners than the sealed portions 58 and 59, circular arc-shaped cut-ins 68 and 69 are formed, respectively, in the surfaces of the films 56 and 57 of the outer bag 53, for gas blow-in.

Next, the method (packaging method) for manufacturing bag with a gas filling compartment products by a rotary type packaging apparatus, using the bag with a gas filling compartment 51, is described with reference to FIGS. 13(*a*) through 16.

Figure 5:
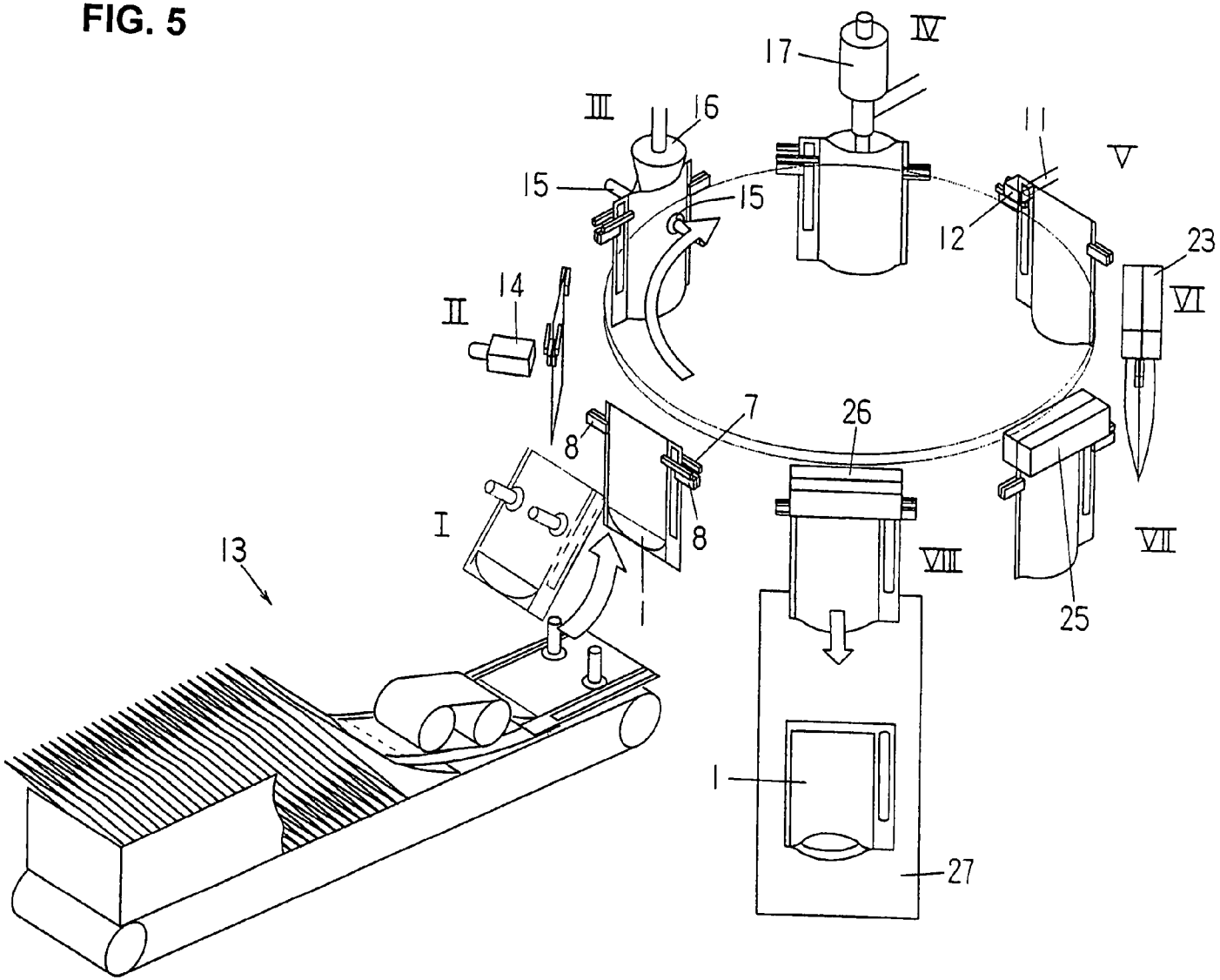
FIG. 5 is a schematic perspective view of a rotary type packaging apparatus for implementing the gas seal-in method and packaging method of the present invention.

In this rotary type packaging apparatus, moreover, as in the rotary type packaging apparatus shown in FIG. 5, gas filling means (comprising a blow-in nozzle 11 and a backing member 12) and auxiliary grippers 71 and 72 are provided.

Figure 15C:
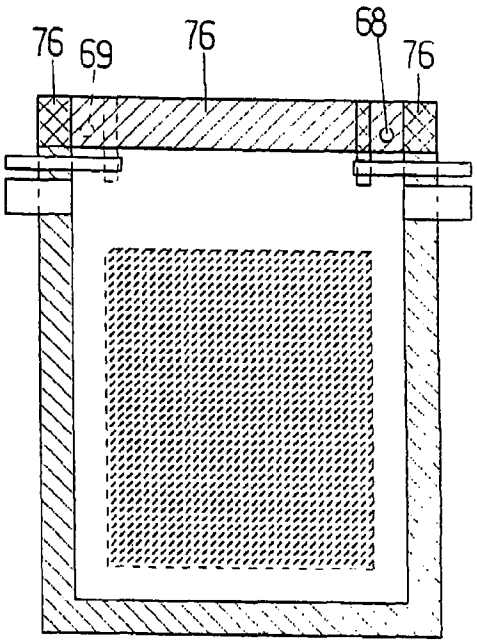
FIGS. 15(*a*) through 15(*c*) are schematic front elevational views of the bag with a gas filling compartment when, in the gas seal-in method and packaging method of the present invention, the bag is at, respectively, the contents filling process position, the gas filling process position, and the bag mouth sealing process position.
Figure 15B:
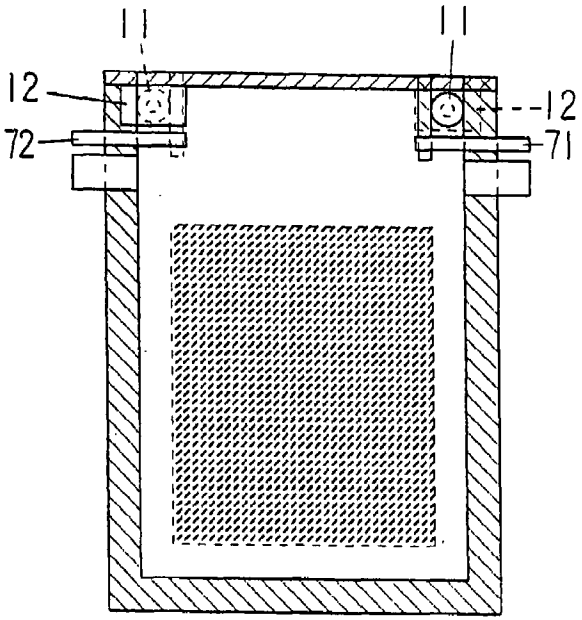
Figure 15A:
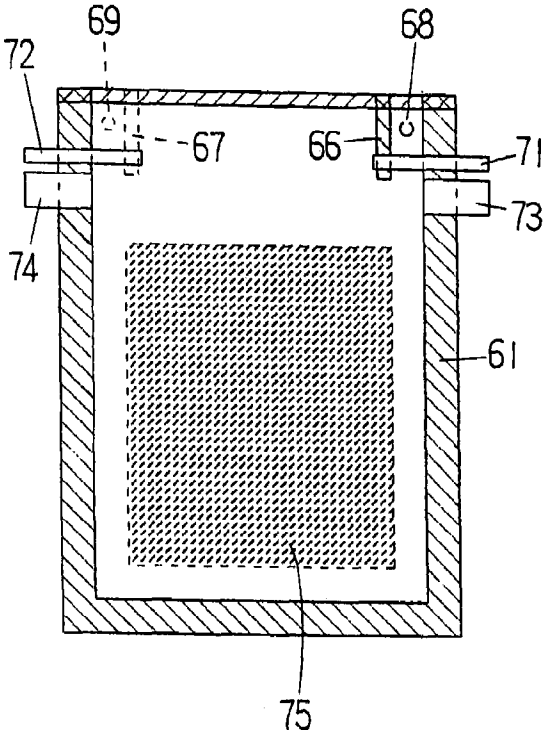

The auxiliary grippers 71 and 72, as shown in FIG. 15(*a*), are provided, respectively, in positions directly above the grippers 73 and 74, made horizontal in the length direction, each being capable of opening and closing so as to be able to hold the bag 51 from both sides. FIG. 15(*a*) is a front elevational view (after the filling) of the bag at the filling process position for filling the inside of the inner bag 52 of the bag 51 with contents to be packaged 75. At this point in time, neither of the sets of auxiliary grippers 71 and 72 is closed; however, as may be understood from this figure, when the auxiliary grippers 71 are closed, the bag surfaces below the cut-in 68 are held so as to bridge across from the sealed portion 61 to the supplementary sealed portion 66, and, when the auxiliary grippers 72 are closed, the bag surfaces below the cut-in 69 are held so as to bridge across from the sealed portion 62 to the supplementary sealed portion 67, so that the flow of gas between the cut-ins 68 and 69, on the one hand, and the inside of the gas filling compartments 64 and 65, on the other, is cut off.

With this packaging method, up to the filling of the contents to be packaged, the same operations as for the bag 1 are performed. The gas seal-in process (comprising a gas filling process and a cut-in sealing process) from the packaged contents filling process on is conducted as follows:

(1) After the filling of the contents to be packaged (see FIG. 15(*a*)), the table of the rotary type packaging apparatus turns, and, as shown in FIG. 13(*a*), the grippers 73 and 74 gripping the two edges of the bag 51 stop at the next stop position (the gas filling process position). At this stop position, the blow-in nozzle 11 is provided so as to be positioned just before the cut-in 68 formed in the bag 51, and the backing member 12 facing the blow-in nozzle 11 is provided, on the opposite side, sandwiching the bag 51. Also, although omitted from the diagram in FIG. 13(*a*), another set of a blow-in nozzle 11 and a backing member 12 is provided at this stop position, facing in the same manner in correspondence with the cut-in 69.

Figure 16:
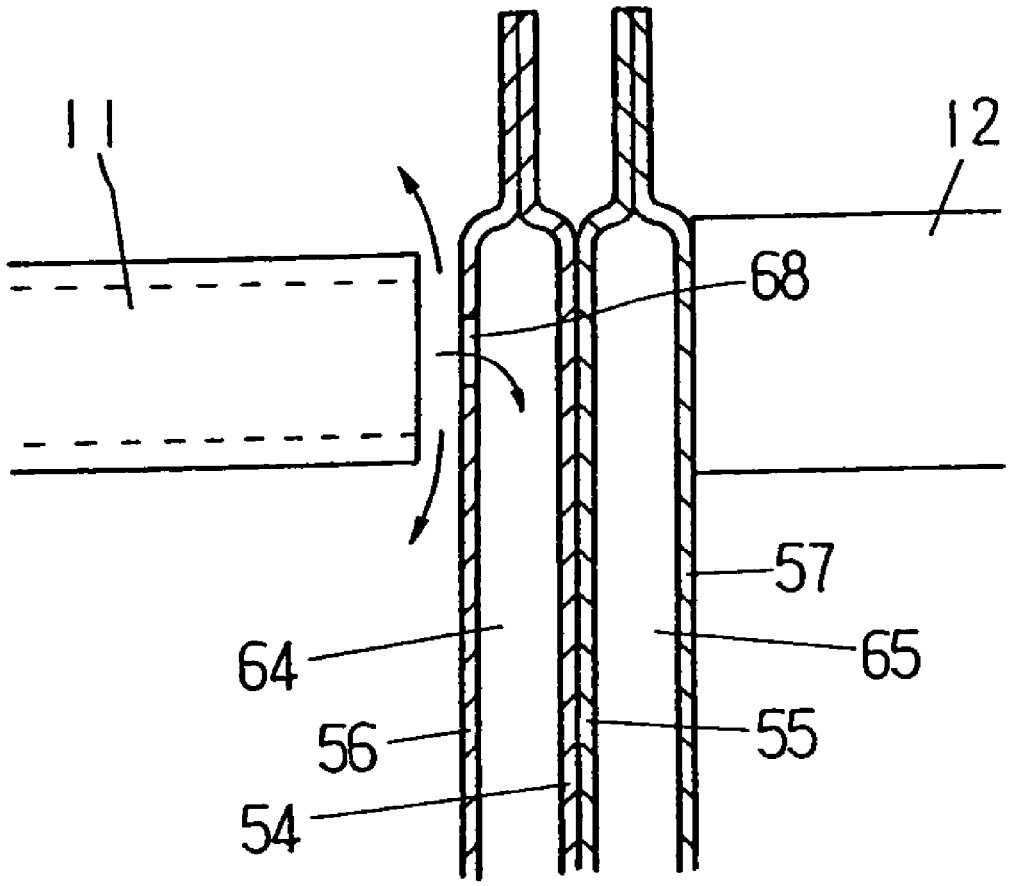
FIG. 16 is a side view showing the gas filling done by a gas blow-in nozzle.

(2) As shown in FIG. 13(*b*), the blow-in nozzle 11 and the backing member 12 advance together, the blow-in port at the tip of the blow-in nozzle 11 makes contact with the bag surfaces at the periphery of the cut-in 68, the back surface thereof is supported by the backing member 12, and, simultaneously, pressurized air (gas) is blown out from the tip of the blow-in nozzle 11. When the air (gas) blow-out starts, due to that air (gas) pressure, the blow-in nozzle 11 moves back slightly against the energizing force of the compression spring 18, whereby, as shown in FIG. 16, a gap develops between the films 54 and 56 configuring the gas filling compartment 64, air (gas) is blown in through the cut-in 68 to the inside of the gas filling compartment 64, and the gas filling compartment 64 distends. Simultaneously therewith, on the gas filling compartment 65 side also, air (gas) blow-in is effected, through the cut-in 69, by the blow-in nozzle 11 and the backing member 12.

(3) As shown in FIG. 13(*c*) and FIG. 15(*b*), the auxiliary grippers 71 and 72 close and hold the bag surfaces from both sides, the flow of gas between the cut-ins 68 and 69, on the one hand, and the inside of the gas filling compartments 64 and 65, on the other, is cut off, and the air (gas) with which the inside of the gas filling compartments 64 and 65 is filled is prevented from escaping through the cut-ins 68 and 69 to the outside. Then the blowing out of air (gas) from the blow-in nozzle 11 (blowing in of air (gas) to the inside of the gas filling compartments 64 and 65) is stopped.

(4) As seen from FIG. 13(*d*), the blow-in nozzle 11 and the backing member 12 move back away from the bag surfaces. Thereupon, the gas filling process ends.

Figure 14G:
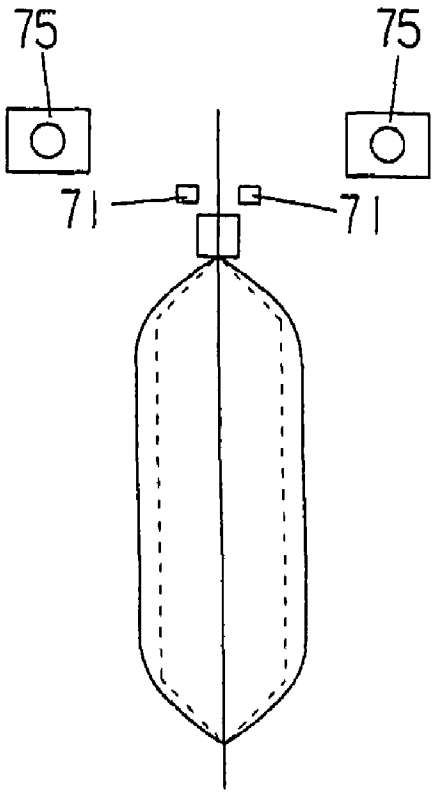
FIGS. 14(*e*) through 14(*g*) show the process order after the step of FIG. 13(*d*)
Figure 14F:
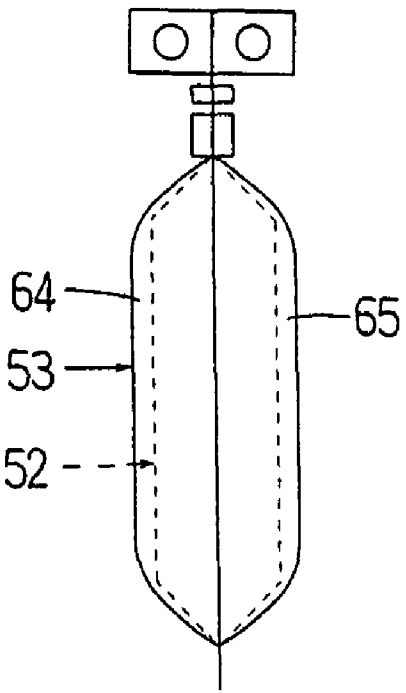
Figure 14E:
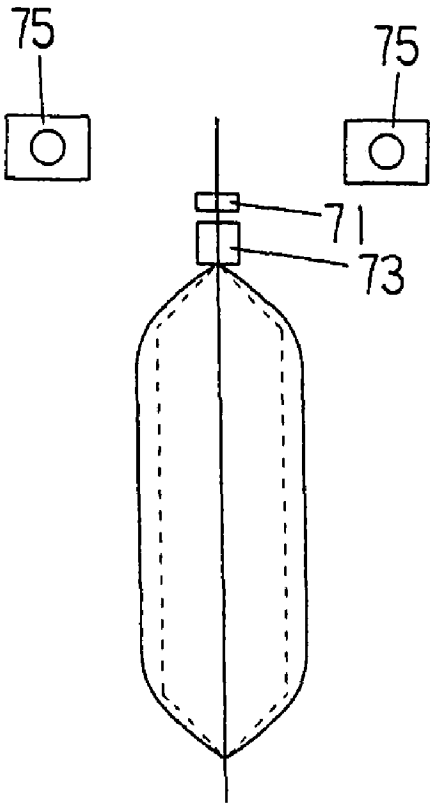

(5) Then the table of the rotary type packaging apparatus turns, and the grippers 73 and 74 gripping the two edges of the bag 51 stop at the next stop position (the bag mouth sealing process position). At this stop position, a bag mouth sealing process is conducted in conjunction with a cut-in sealing process. At this stop position, as shown in FIG. 14(*e*), a bag mouth sealing mechanism (indicated only by hot plates 75) is provided. When the hot plates 75, which have a width in the height direction capable of covering the cut-ins 68 and 69, are closed, all of the films 54 to 57 at the bag mouth are sealed, sealing the packaged contents inside the bag 1, and, simultaneously therewith, the films 54 to 57 are also sealed together at the locations of the cut-ins 68 and 69, sealing the gas inside the gas filling compartments 64 and 65. The sealed portions 76 at the bag mouth sealed by the hot plates 75 are indicated in FIG. 15(*c*). In this manner, the locations of the cut-ins 68 and 69 are also sealed together.

(6) As shown in FIG. 14(*g*), the hot plates 75 and the auxiliary grippers 71 and 72 open, so that the bag with a gas filling compartment product is finished. From this point on, the same operations are performed as for the bag 1.

The invention claimed is:

1. A method for sealing-in a gas in a bag with a gas filling compartment, wherein:

said method uses a bag with a gas filling compartment which is capable of having a gas sealed therein and is separated from a contents storing section, said bag being further formed, in surfaces of films that define the gas filling compartment, with a means for introducing gas for effecting communication between an inside of the gas filling compartment and an outside of said bag; and wherein, said method comprises the steps of:

placing a blow-out port of a nozzle, which is connected to a pressurized gas supply source, against said means for introducing gas and supporting a back surface side of said bag with a backing member, blowing a gas from said nozzle into an inside of the gas filling compartment through said means for introducing gas, gripping a part near said means for introducing gas from both surfaces of said bag with a blocking gripper while the gas blow-in continues, thus cutting off a flow of gas between said means for introducing gas and an inside of the gas filling compartment, and sealing said means for introducing gas, thus allowing the gas to be sealed in the gas filling compartment.

2. The method for sealing-in a gas in a bag with a gas filling compartment according to claim 1, wherein sealing of said means for introducing gas is effected by sealing both surfaces of said bag at location of said means for introducing gas.

3. The method for sealing-in a gas in a bag with a gas filling compartment according to claim 2, wherein, in said bag with a gas filling compartment, said means for introducing gas is formed in the vicinity of a bag mouth of said bag, and after the flow of gas between said means for introducing gas and the inside of the gas filling compartment is cut off, the entire bag mouth is sealed from both surfaces of said bag, at which time said means for introducing gas is sealed together therewith, thus sealing the gas inside the gas filling compartment.

4. The method for sealing-in a gas in a bag with a gas filling compartment according to claim 1, wherein said bag with a gas filling compartment is a bag in which the gas filling compartment has a closed contour formed to extend in a longitudinal direction between films that make front and back surfaces in sealed portions at lateral side edges of said bag.

5. The method for sealing-in a gas in a bag with a gas filling compartment according to claim 4, wherein said bag with a gas filling compartment is a bottom-gusseted type self-standing bag.

6. The method for sealing-in a gas in a bag with a gas filling compartment according to claim 5, wherein said bag with a gas filling compartment is a bag in which:

a lower edge of the gas filling compartment formed in lateral side edge sealed portions extends further downward, and the gas filling compartment is formed also between films that make the front and back surfaces of said bag and a film that makes a bottom surface of said bag.

7. The method for sealing-in a gas in a bag with a gas filling compartment according to claim 1, wherein said bag with a gas filling compartment is a bag in which:

said films that make the front and back surfaces of said bag are laminated films; and the gas filling compartment having a closed contour is formed to extend in a longitudinal direction in an interior of at least one of the laminated films that make the front and back surfaces of said bag.

8. The method for sealing-in a gas in a bag with a gas filling compartment according to claim 7, wherein said bag with a gas filling compartment is a bottom-gusseted type self-standing bag.

9. The method for sealing-in a gas in a bag with a gas filling compartment according to any one of claims 4 to 8, wherein said bag with a gas filling compartment is a bag in which:

the gas filling compartment extends downward from the vicinity of upper edges of the lateral side edge sealed portions, and said means for introducing gas is formed in the vicinity of an upper edge of the gas filling compartment; and after holding a position downward from said means for introducing gas with said cut-off gripper and thus cutting off the flow of gas between said means for introducing gas and the inside of the gas filling compartment, the bag mouth is sealed from both surfaces of said bag, at which time said means for introducing gas is sealed together therewith, thus sealing the gas inside the gas filling compartment.

10. The method for sealing-in a gas in a bag with a gas filling compartment according to any one of claims 4 to 8, wherein said bag with a gas filling compartment is a spout-equipped bag having a spout inserted and sealed in the bag mouth thereof.

11. The method for sealing-in a gas in a bag with a gas filling compartment according to claim 10, wherein said bag with a gas filling compartment is a bag in which the gas filling compartment extends downward from the vicinity of upper edges of the lateral side edge sealed portions, and said means for introducing gas is formed in the vicinity of an upper edge of the gas filling compartment; and after holding a position downward from said means for introducing gas with said cut-off gripper and thus cutting off the flow of gas between said means for introducing gas and the inside of the gas filling compartment, the bag mouth is sealed from both surfaces of said bag, so that sealing is performed both between films at the bag mouth and between the films at the bag mouth and the spout, at which time said means for introducing gas is sealed together therewith, thus sealing the gas inside the gas filling compartment.

12. A method for packaging a bag with a gas filling compartment wherein bags, held at both lateral side edges thereof by grippers and suspended, are conveyed; and during a course of said bag conveyance, various packaging processes including bag mouth opening, filling said bag with contents to be packaged, and bag mouth sealing are successively performed; wherein said method uses a bag with a gas filling compartment which is capable of having a gas sealed therein and is separated from a contents storing section, said bag being further formed, in surfaces of films that define the gas filling compartment, with a means for introducing gas for effecting communication between an inside of the gas filling compartment and an outside of said bag, and said means for introducing gas being formed in the vicinity of a bag mouth of said bag; and wherein, a process for sealing gas in the gas filling compartment of said bag is executed after a process for filling said bag with contents to be packaged; and said process for sealing gas comprises the steps of:

placing a blow-out port of a nozzle, which is connected to a pressurized gas supply source, against said means for introducing gas and supporting a back surface side of said bag with a backing member, blowing a gas from said nozzle into an inside of the gas filling compartment through said means for introducing gas, gripping a part near said means for introducing gas from both surfaces of said bag by a blocking gripper while the gas blow-in continues, thus cutting off a flow of gas between said means for introducing gas and an inside of the gas filling compartment, and sealing the bag mouth of said bag from both surfaces of said bag, at which time said means for introducing gas is sealed together therewith, thus sealing the gas inside the gas filling compartment.

13. The method for packaging a bag with a gas filling compartment according to claim 12, wherein said bag with a gas filling compartment is a bag in which:

the gas filling compartment has a closed contour formed to extend in a longitudinal direction of said bag between films that make front and back surfaces in sealed portions at lateral side edges of said bag, the gas filling compartment extends downward from the vicinity of upper edges of the lateral side edge sealed portions, and said means for introducing gas is formed in the vicinity of an upper edge of the gas filling compartment; and wherein after holding a position downward from said means for introducing gas with said cut-off gripper and cutting off the flow of gas between said means for introducing gas and the inside of the gas filling compartment, sealing the overall bag mouth from both surfaces of said bag, at which time said means for introducing gas is sealed together therewith, thus sealing the gas inside the gas filling compartment.

14. The method for packaging a bag with a gas filling compartment according to claim 13, wherein said bag with a gas filling compartment is a bottom-gusseted type self-standing bag.

15. The method for packaging a bag with a gas filling compartment according to claim 14, wherein said bag with a gas filling compartment is a bag in which:

a lower edge of the gas filling compartment formed in lateral side edge sealed portions extends further downward, and the gas filling compartment is formed also between films that make the front and back surfaces of said bag and a film that makes a bottom surface of said bag.

16. The method for packaging a bag with a gas filling compartment according to claim 12, wherein said bag with a gas filling compartment is a bag in which:

films that make the front and back surfaces of said bag are laminated films, a gas filling compartment having a closed contour is formed to extend in a longitudinal direction in an interior of at least one of the laminated films that make the front and back surfaces of said bag, the gas filling compartment extends downward from the vicinity of upper edges of the lateral side edge sealed portions, and said means for introducing gas is formed in the vicinity of an upper edge of the gas filling compartment; and wherein after holding a position downward from said means for introducing gas with said cut-off gripper and thus cutting off the flow of gas between said means for introducing gas and the inside of the gas filling compartment, the bag mouth is sealed from both surfaces of said bag, at which time said means for introducing gas is sealed together therewith, thus sealing the gas inside the gas filling compartment.

17. The method for packaging a bag with a gas filling compartment according to 16, wherein said bag with a gas filling compartment is a bottom-gusseted type self-standing bag.

18. A method for packaging a bag with a spout, wherein said method conveys a bag with a spout by inserting a bifurcated spout holding member between upper and lower flanges formed in the spout of said bag; and in the course of bag conveyance, packaging processes including sealing films at a bag mouth of said bag and spouts, making seals between the films at the bag mouth, filling said bag with contents to be packaged, and capping the spouts, are successively performed; and said bag with a spout is formed with a gas filling compartment which is capable of having a gas sealed therein and is separated from a contents storing section, said bag being further formed, in surfaces of films that define the gas filling compartment, with a means for introducing gas for effecting communication between an inside of the gas filling compartment and an outside of said bag, and said means for introducing gas being formed in the vicinity of a bag mouth of said bag; and wherein a process for sealing gas in the gas filling compartment of said bag is executed after a process for filling said bag with contents to be packaged; and said process for sealing gas comprises the steps of:

placing a blow-out port of a nozzle, which is connected to a pressurized gas supply source, against said means for introducing gas and supporting a back surface side of said bag with a backing member, blowing a gas from said nozzle into an inside of the gas filling compartment through said means for introducing gas, gripping a part near said means for introducing gas from both surfaces of said bag by a blocking gripper while the gas blow-in continues, thus cutting off a flow of gas between said means for introducing gas and an inside of the gas filling compartment, and sealing the bag mouth of said bag from both surfaces of said bag, at which time said means for introducing gas is sealed together therewith, thus sealing the gas inside the gas filling compartment.

19. The method for packaging a bag with a spout according to claim 18, wherein:

said bag with a spout is a bag in which:

the gas filling compartment has a closed contour formed to extend in a longitudinal direction of said bag between films that make front and back surfaces in sealed portions at lateral side edges of said bag, the gas filling compartment extends downward from the vicinity of upper edges of the lateral side edge sealed portions, and said means for introducing gas is formed in the vicinity of an upper edge of the gas filling compartment; and wherein after holding a position downward from said means for introducing gas with said cut-off gripper and cutting off the flow of gas between said means for introducing gas and the inside of the gas filling compartment, the bag mouth is sealed from both surfaces of said bag, so that sealing is performed both between films at the bag mouth and between the films at the bag mouth and the spout, at which time said means for introducing gas is sealed together therewith, thus sealing the gas inside the gas filling compartment.

20. The method for packaging a bag with a spout according to claim 19, wherein said bag with a spout is a bottom-gusseted type self-standing bag.

21. The method for packaging a bag with a spout according to claim 20, wherein said bag with a spout is a bag in which:

a lower edge of the gas filling compartment formed in lateral side edge sealed portions extends further downward; and the gas filling compartment is formed also between films that make the front and back surfaces of said bag and a film that makes a bottom surface of said bag.

22. The method for packaging a bag with a spout according to claim 18, wherein said bag with a spout is a bag in which:

films that make the front and back surfaces of said bag are laminated films, a gas filling compartment having a closed contour is formed to extend in a longitudinal direction in an interior of at least one of the laminated films that make the front and back surfaces of said bag, the gas filling compartment extends downward from the vicinity of upper edges of the lateral side edge sealed portions, and said means for introducing gas is formed in the vicinity of an upper edge of the gas filling compartment; and wherein after holding positions downward from said means for introducing gas with said cut-off gripper and thus cutting off the flow of gas between said means for introducing gas and the inside of the gas filling compartment, the bag mouth is sealed from both surfaces of said bag, so that sealing is performed both between films at the bag mouth and between the films at the bag mouth and the spout, at which time said means for introducing gas is sealed together therewith, thus sealing the gas inside the gas filling compartment.

23. The method for packaging a bag with a spout according to claim 22, wherein said bag with a spout is a bottom-gusseted type self-standing bag.

* * * * *